US007226123B1

(12) United States Patent
Lin et al.

(10) Patent No.: US 7,226,123 B1
(45) Date of Patent: Jun. 5, 2007

(54) STRUCTURE FOR A SEAT SUPPORTING FRAME OF A CHAIR

(76) Inventors: Mei Chuen Lin, 9F, No. 275-1, Yuan-Hua Road, Chung-Li City, Taoyuan Hsien (TW); Tzu Mei Wang, 9F, No. 275-1, Yuan-Hua Road, Chung-Li City, Taoyuan Hsien (TW)

( * ) Notice: Subject to any disclaimer, the term of this patent is extended or adjusted under 35 U.S.C. 154(b) by 0 days.

(21) Appl. No.: 11/565,850

(22) Filed: Dec. 1, 2006

(51) Int. Cl.
*A47C 4/48* (2006.01)

(52) U.S. Cl. ..... 297/56

(58) Field of Classification Search ..... 297/16.1, 297/41, 55, 56
See application file for complete search history.

(56) References Cited

U.S. PATENT DOCUMENTS 1,600,248 A * 9/1926 Rosenthal et al. ..... 297/56
2,247,236 A * 6/1941 Johannsen ..... 297/19
2,548,098 A * 4/1951 Clarin ..... 297/30
2,675,062 A * 4/1954 Clarin ..... 297/41
2,982,339 A * 5/1961 Clarin ..... 297/56
3,001,816 A * 9/1961 Clarin ..... 297/56
4,319,779 A * 3/1982 Leonhart ..... 297/19
4,564,212 A * 1/1986 Orlandino et al. ..... 280/642
6,478,375 B2 * 11/2002 Richardson ..... 297/248

* cited by examiner

*Primary Examiner*—Peter R. Brown
(74) *Attorney, Agent, or Firm*—Rabin & Berdo, P.C.

(57) ABSTRACT

An improved structure for a seat supporting frame of a chair includes a seat, front legs and back legs mounted on the two sides, a horizontal support having flattened ends and forming a bent section. The bent section is welded with the inner side of the front leg. The two ends of the bent corners are formed with a curved section. The sides of the seat has vertical support pieces, one end of which is set on the side of the seating frame, and the other end is connected to the front leg. A stop abutment, mounted on the lower section of the vertical support piece, is firmly abutted to the inner side of the curved section of the horizontal support, so as to prevent it from sliding and fracture. The horizontal support, the front leg, the vertical support piece, and the stop abutment are held together tightly.

1 Claim, 7 Drawing Sheets

STRUCTURE FOR A SEAT SUPPORTING FRAME OF A CHAIR

BACKGROUND OF THE INVENTION

1. Field of the Invention

The present invention is related to an improved structure for a seat supporting frame of a chair, especially is related to having a horizontal a support, front leg, a vertical support piece, and a stop abutment to be held together secure and tightly, and thereby preventing the chair from loosening because of having a heavy people sitting in the chair.

2. The Prior Arts

With reference to FIG. 1 and FIG. 1A, which is the partial enlarged view showing the horizontal support A, the front leg B, the vertical support piece C, and the stop abutment C1 in the conventional folding chair, the seat supporting spots of the conventional folding chair are located between a seat D and a back leg E, the seat D and the stop abutment C1, the seat D and the horizontal support A. So the joining together and interactions between the four parts is important.

It is observed that the stop abutment C1 connected to the vertical support piece C of the front leg B would be fractured or moved to the outer portion of the horizontal support A easily, because of the seat D having to support a person with a heavy load, and the fact that typically people changing their sitting postures constantly. If the above situation is prolonged for an extended duration, the joining together between the seat D, the front leg B, and the back leg E of the chair will be loosened, so that the stop abutment of the chair abutting on the horizontal support A will be fractured and becomes useless. It is another disadvantage that the chair will not be folded smoothly towards the inner side of the front leg B when the stop abutment C1 is moved to the outside.

In addition, the horizontal support A of the typical conventional folding chair is formed with the two ends bent into a wavy shape. The wave crest section of one end is welded to the curled edge B1 along the circumference of the front leg B; and the wave trough section is extended and welded inside the channel B2 of the front leg B. The horizontal support A is connected to the front leg B by means of the two wavy shaped ends of the support. The welded portion between the horizontal support A and the front leg B is not flat but is curved; therefore, it is more difficulty to weld it than to weld flat surfaces, saying nothing of the worker's inadequate welding technique. As a result, some folding chairs may be of unacceptable quality. The horizontal support A would not able to support the seat D if it is loosened. Additionally, it is very dangerous for the person sitting if the stud C2 above the stop abutment C1 is loosened as well.

With reference to FIG. 1B showing another kind of conventional folding chair, a horizontal support F of the chair with the two ends of which are bent and welded also at the inner side of the front leg G, is also not formed with a curved section for keeping the stop abutment H from moving outside. As a result, the above chair has the same disadvantage as the previous one having the seating frame to be fractured.

SUMMARY OF THE INVENTION

According to the above disadvantage of the conventional folding chair, the inventor intends to improve the engaging and positioning structure between the stop abutment and the horizontal support. The two ends of a horizontal support at the back of a chair are formed with curved sections, respectively, so as to ensure that a stop abutment on the lower portion of a vertical support piece to not to move and bend towards the outer portion of the horizontal support resulting in all of the frame become distorted and loosened, or unable to be properly positioned due to the heavy load of a person sitting or people changing postures frequently. As a result, the chair is thereby completely damaged, become useless, and has its lifespan reduced.

Based upon the aforementioned, the present invention intends to solve two problems. One is to ensure the stop abutment to not move or bend from the out side of the horizontal support for resulting in inclining and fracturing because of people's changes in posture. The other problem to be solved is to ensure the stop abutment to be consistently firmly abutting against the inner portion of the curved section on the two ends of the horizontal support for the proper support, balancing, and placement on the horizontal support. The method to solve the problems is as follows.

First, a horizontal support is designed. And the two ends of the horizontal support are made to be flattened and bent to form a curved section, in which the outside surface of the folded bent section is flat, and can be evenly welded on the inner side of the two long beams of the front leg so as to solve the problem that the support to dislodge from the front leg. The horizontal support is mounted horizontally below the seat, and the two ends that are bent end sections are both each formed to a curved section, respectively.

A vertical support piece is riveted onto the seating frame by means of a stud, and the upper section of the vertical support piece is welded on the inner side of a front leg. A stop abutment is extended along the lower part of the vertical support piece, which can be firmly abutted against the inside edge of the curved section on the two ends of the horizontal support and is not overextending past the curved section, when the chair is unfolded. Because the space between the curved section of the horizontal support and the edge surface of the seat is small, the stop abutment, which is firmly abutted and positioned on the horizontal support, has only a small offset gap; therefore, the stop abutment would only shift a tiny amount of distance, and would not move past the surface of the curved section of the horizontal support even when the chair is to be supporting a very heavy load, or that the user on the chair changes his posture again and again.

For the horizontal support according to the present invention because of having flat surfaces at the two ends, it is easier to weld the horizontal support with the front leg and to weld more tightly than the conventional horizontal support, whose two ends extend to the front leg and must be welded along the curled edge of the front leg. The welding technique for the conventional horizontal support is difficult, and the welded part is not very firm. In addition, the raised curved surface formed at the curved section at the end of the horizontal support according to the present invention can prevent the stop abutment from moving beyond the outside of the ends. Compared to the horizontal support in the present invention, the conventional horizontal support does not have the curved section, and the stop abutment would shift, tilt, and move toward the outer sides of the front leg when the user is moving frequently on the chair. Thus the entire seating frame will be loosened, and would be unsuitable for sitting. In more severe cases, the curled edge may even be fractured, and cannot be positioned and firmly abutted against the horizontal support. As a result, the chair is no longer usable, and has its lifespan reduced.

The loosening and sliding due to the horizontal support and the stop abutment moving passing the outside may not have occurred instantly, but instead can be accumulated over a longer period of time. Furthermore, the loosening can also be due to the user on the chair changing his postures more frequently. As a result, the user's safety must be considered in order to avoid accidents during the manufacturing process of the chair.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Reference will now be made in detail to embodiments of the present invention, examples of which are illustrated in the accompanying drawings. The present invention will be apparent to those skilled in the art by reading the following detailed description of a preferred embodiment and those skilled in the art can operate it according to the reference.

Figure 2:
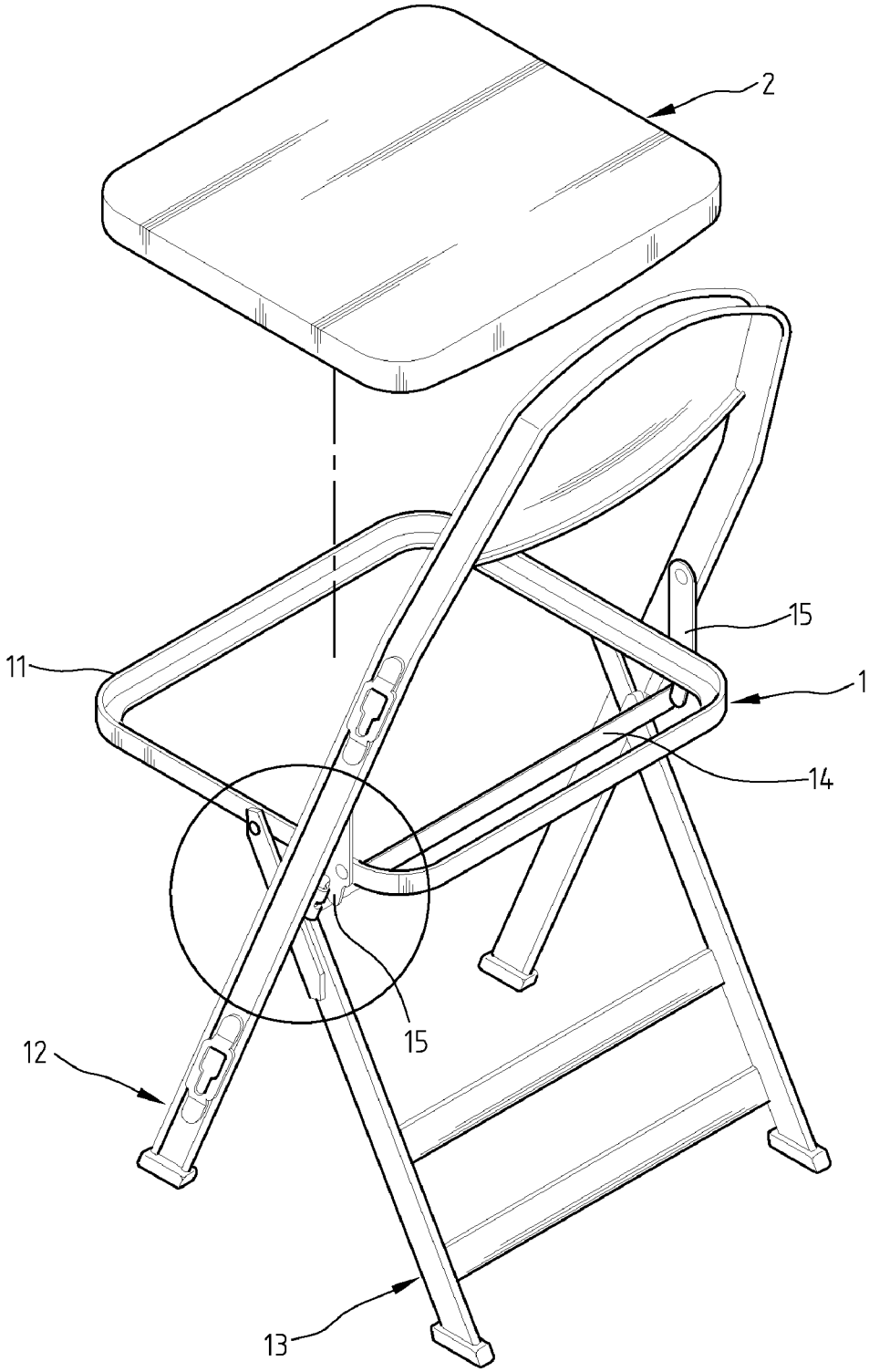
FIG. 2 is an exploded view showing a folding chair and a seat in accordance with a preferred embodiment of the present invention.

The present invention relates to an improved structure for a seat supporting frame of the folding chair. FIG. 2 shows the exploded drawing of a folding chair 1 and a seat 2 in accordance with the preferred embodiment of the present invention. A folding chair 1 body comprises a seating frame 11 on which a seat 2 is located, a plurality of front legs 12 and back legs 13 mounted on the two sides of the seating frame 11, and a horizontal support 14 set horizontally between the front legs 12. A vertical support piece 15 is formed between the side of the seating frame 11 and the side of the front leg 12. A stop abutment 151 is formed on the lower portion of the vertical support piece 15.

Figure 2A:
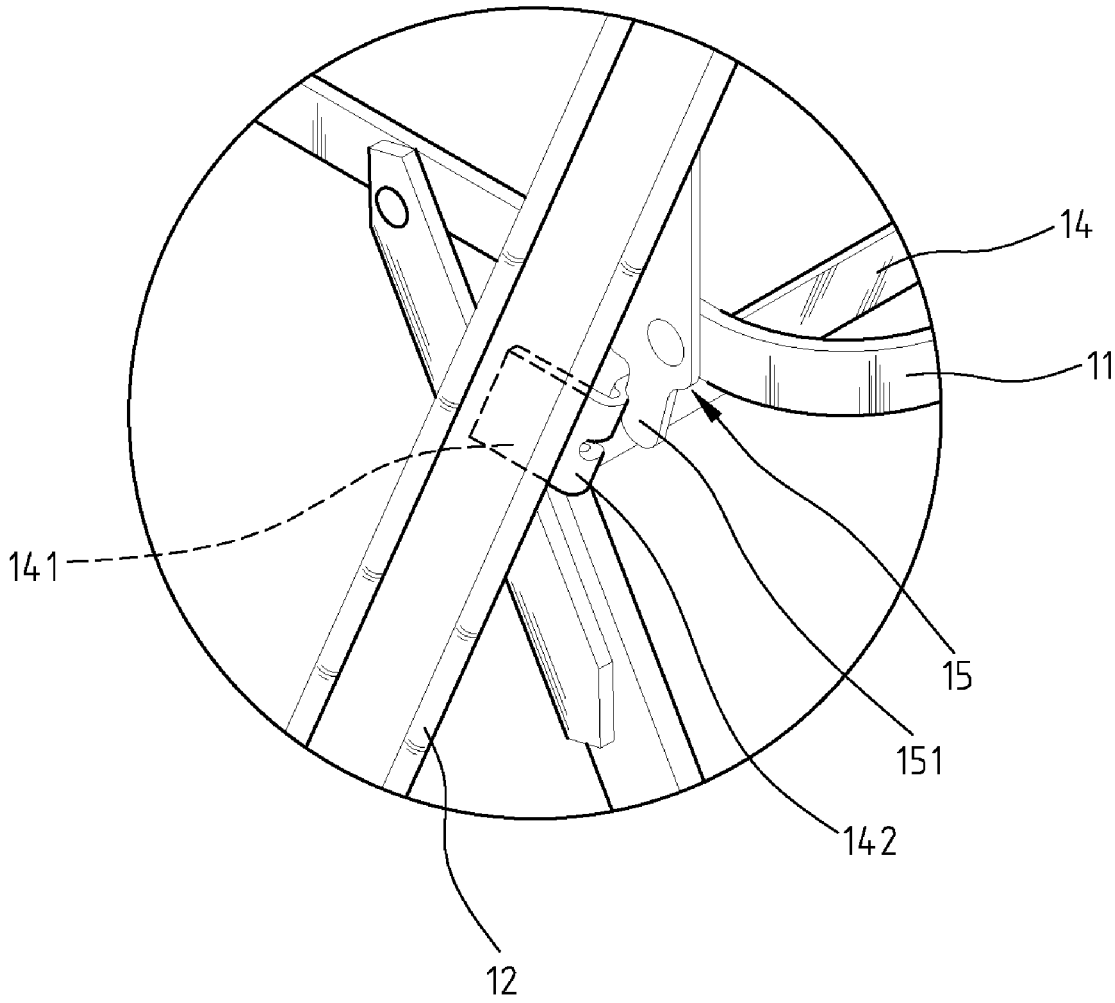
FIG. 2A is a partial enlarged view showing the abutting configuration between a horizontal support, a stop abutment, a front leg, and a curved section in accordance with the present invention.
Figure 3:
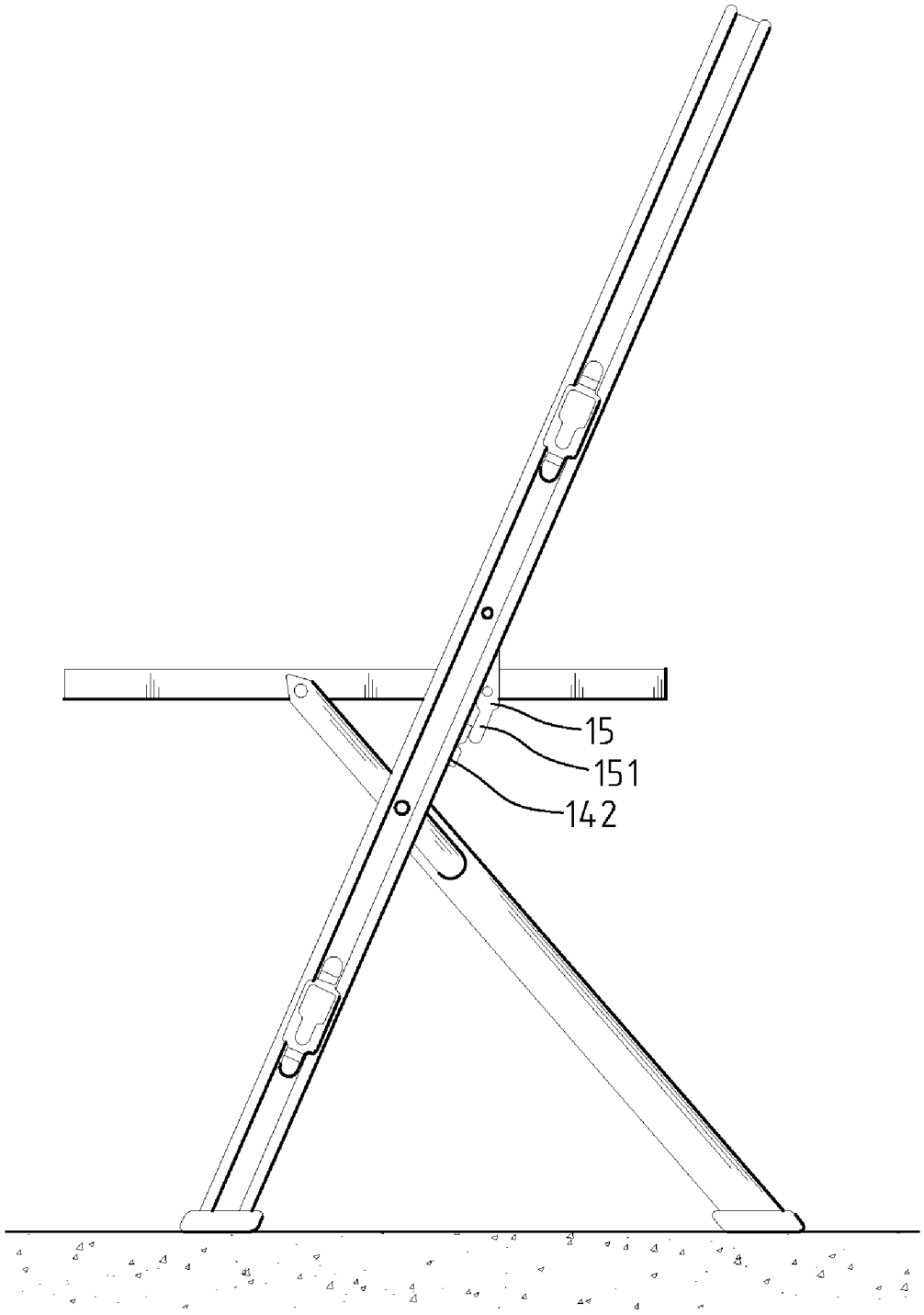
FIG. 3 is a schematic view showing a folding chair being unfolded completely in accordance with the present invention.

The inventor mainly improves the abutting structure of the horizontal support 14 and the vertical support piece 15 in order to solve the dislocation problem of the supporting spot because of excessive load on the chair. FIG. 2A is a partial enlarged view showing the abutting cooperative configuration between the horizontal support 14, one of the vertical support pieces 15, and one of the front legs 12 according to the preferred embodiment of the present invention. Wherein, the two ends of the horizontal support are flattened and bent to form two bent sections 141, whose outer sides are flat surfaces, and are welded on the inner side of the flat surface of the front leg 12 on the corresponding side, respectively. The corner bent between the bent section 141 and the horizontal support 14 forms a curved section 142, and the welded horizontal support 14 is tightly abutted to the lower section of the seating frame 11. The vertical support piece 15 is of a single piece design, in which one end of which is fixed on the side of the seating frame 11 by means of the stud, and the other end of which is fixed on the inner side of the front leg 12 and is located above the upper bent section 141. A stop abutment 151 is formed on the lower extending section of the vertical support piece 15. When the chair is unfolded completely (shown in FIG. 3), the vertical support piece 15 is rotated vertically. So the stop abutment 151 is firmly abutted to the interior side of the curved section 142 and does not extend past any further. The horizontal support 14 formed with the curved section 142 and the vertical support piece 15 formed with the stop abutment 151 are located on the inner side of one of the front leg 12, and the gap spacing between the side of the seat 11 and the curved section 142 is very small.

Figure 4:
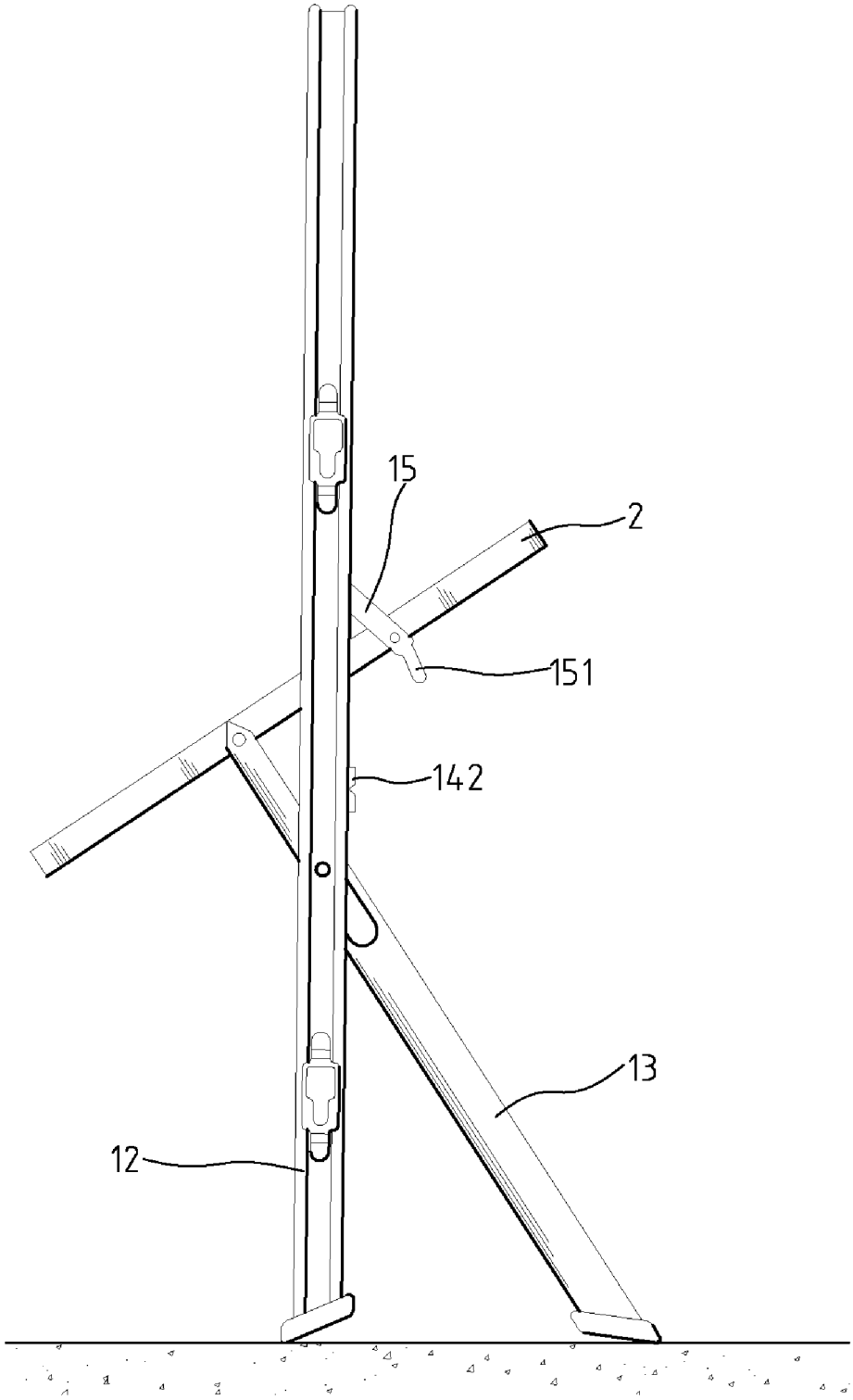
FIG. 4 is a schematic view showing the actions of the folding chair when folded in accordance with the present invention.

FIG. 4 is a schematic view showing the chair when folding. The stop abutment 151 of the vertical support piece 15 is pulled away from the curved section 142 of the horizontal support 14 to using the sides of the seat 2 as pivot, and by means of the seat 2 along with the pivot between the back leg 13 and the front leg 12, to finish rotation inside of the frame body of the front leg 12.

Figure 1:
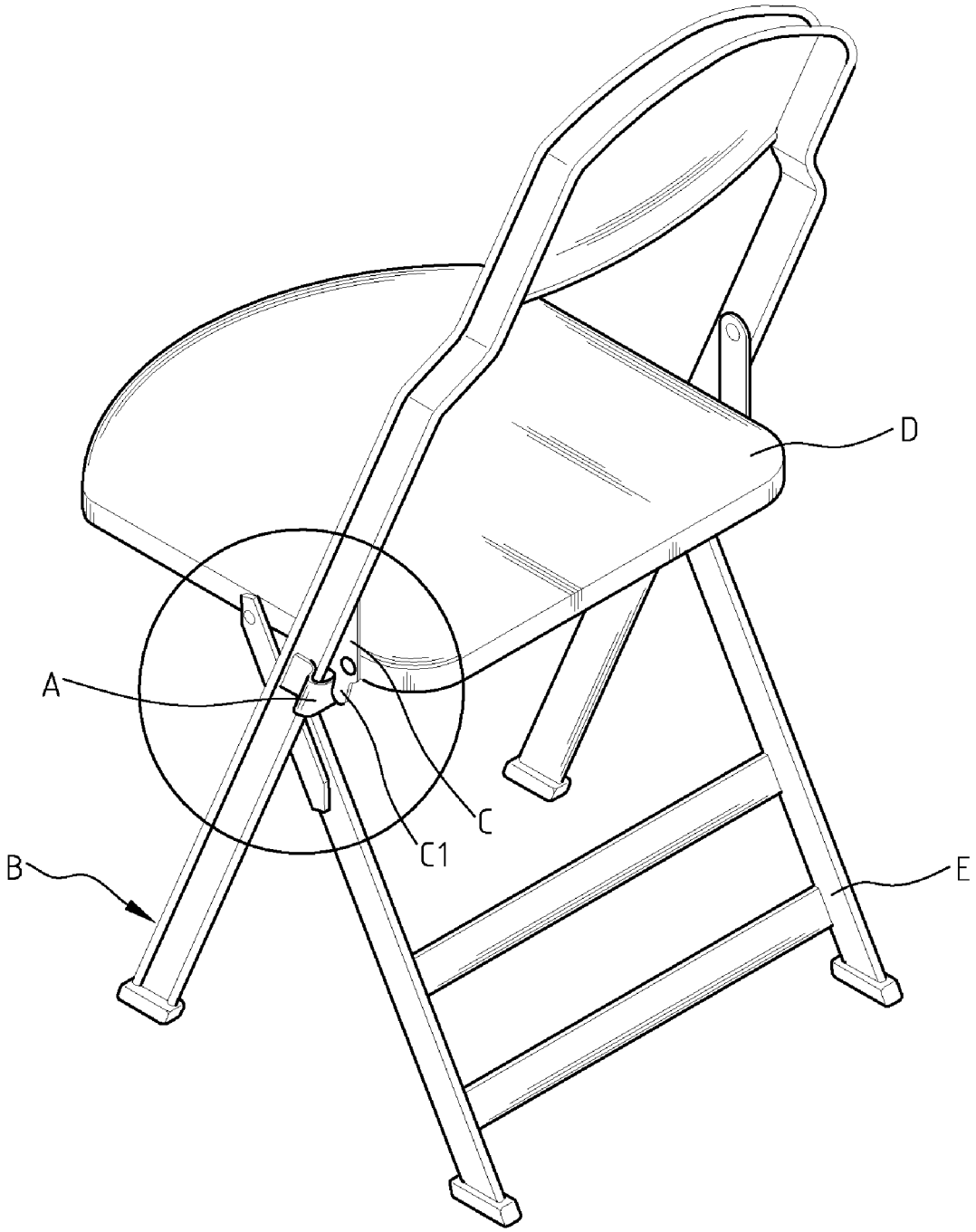
FIG. 1 (Prior Art)
FIG. 1 is a perspective view showing a conventional folding chair.
Figure 1A:
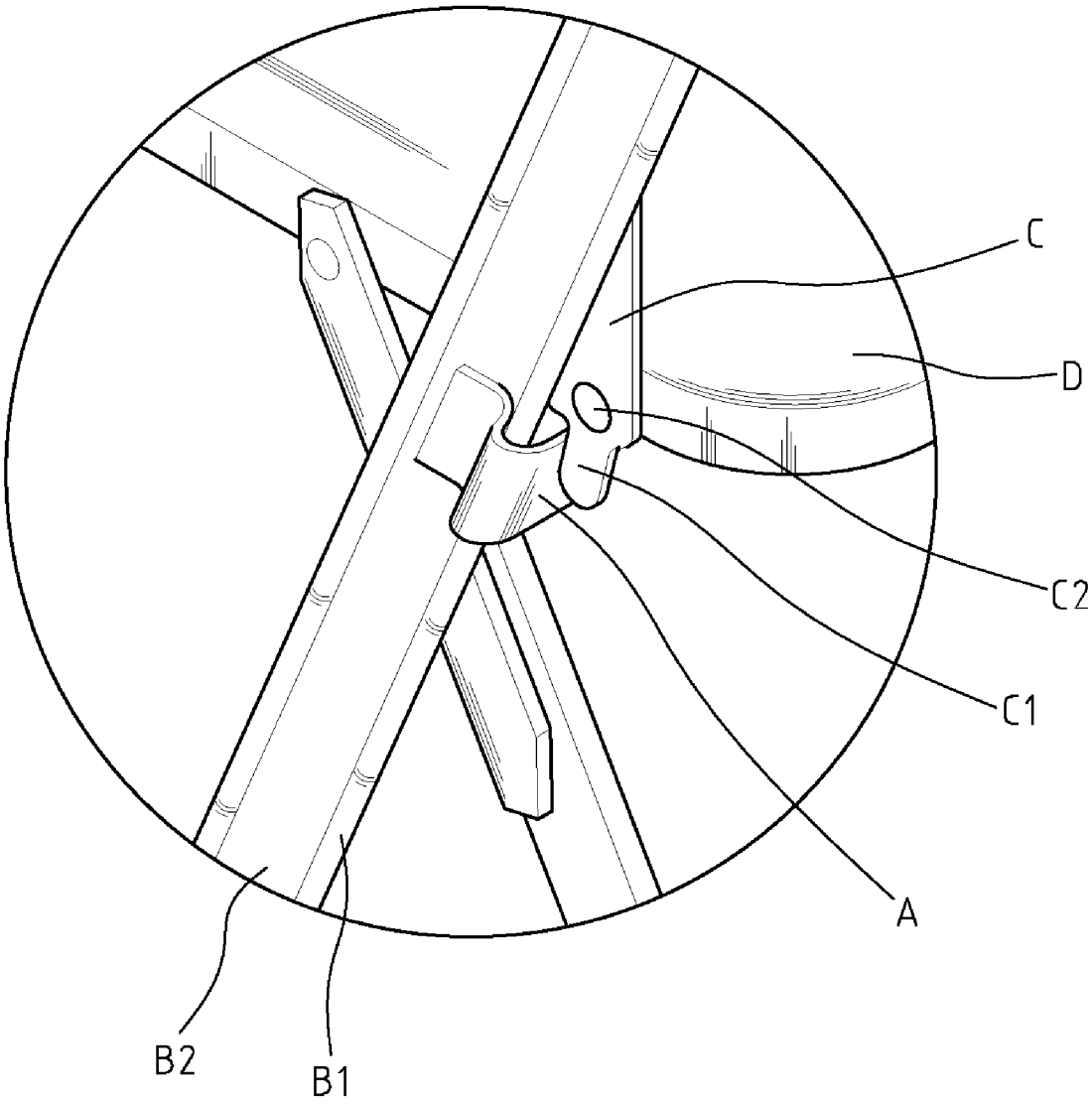
FIG. 1A (Prior Art)
FIG. 1A is a partial enlarged view showing the joining together between a horizontal support, a front leg, and a stop abutment of a conventional folding chair.
Figure 1B:
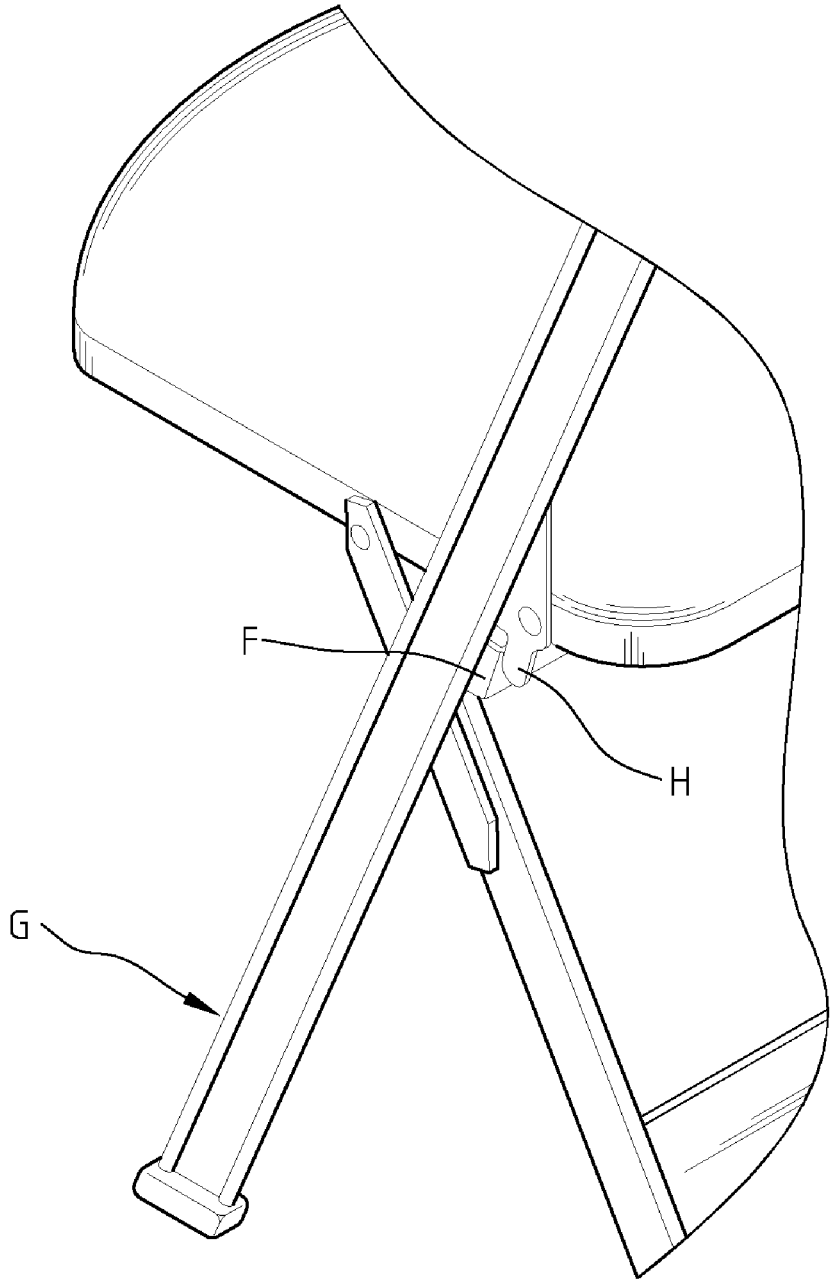
FIG. 1B (Prior Art)
FIG. 1B is a partial enlarged view showing the joining together between a horizontal support, a front leg, and a stop abutment of another conventional folding chair.

With Reference to FIG. 1A showing the conventional folding chair and FIG. 2A showing the present invention, the advantage of the present invention is that the flat surface of the two ends of the horizontal support 14 is welded easily and tightly to the front leg 12. But the conventional horizontal support A whose two ends are extended to the front leg B must be welded along the curled edge B1 of the front leg B. This method of welding is more difficult and is not as secure. In addition, in the present invention, the two ends of the horizontal support 14 are to form a curved section 142, which can prevent the stop abutment 151 of the vertical support piece 15 from moving, shifting, or bending towards the outside. The horizontal support A of the conventional chair (FIGS. 1A and 1B) does not have the curved section 142; therefore, when a person on the chair moves frequently in the seat, the vertical support piece C and the stop abutment C1 will be shifted, tilted, or moved towards the outside of the front leg B, and thereby pulling the stud C2 loose from the side of the seat D. As a result, the seating frame is loosened or damaged.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An improved structure for a seat supporting frame of a chair, comprising:

a seat;

a first front leg and a first back leg mounted on one side of the seat;

a second front leg and a second back leg mounted on another side of the seat;

a first vertical support piece disposed on the one side of the seat, and having one end connected to the one side of the seat, and another end connected to the first front leg, said first vertical support piece having a first stop abutment on a lower section thereof;

a second vertical support piece disposed on the another side of the seat, and having one end connected to the another side of the seat, and another end connected to the second front leg, said second vertical support piece having a second stop abutment on a lower section thereof; and a horizontal support connected to the first and second front legs, and having two flattened ends each of which forms a bent section connected to an inner side surface of a respective front leg, each of the bent sections forming a curved section, said stop abutments firmly abutting against an inner side of a respective curved section when the chair is unfolded.

* * * * *